US006694522B1

(12) United States Patent
Neal

(10) Patent No.: US 6,694,522 B1
(45) Date of Patent: Feb. 24, 2004

(54) UNIVERSAL HOSPITAL GOWN

(76) Inventor: Jay G. Neal, 40151 Erva La., Leonardtown, MD (US) 20650

( * ) Notice: Subject to any disclaimer, the term of this patent is extended or adjusted under 35 U.S.C. 154(b) by 0 days.

(21) Appl. No.: 10/409,267

(22) Filed: Apr. 8, 2003

(51) Int. Cl.[7] ..... A41D 10/00
(52) U.S. Cl. ..... 2/114; 2/69
(58) Field of Search ..... 2/69, 69.5, 83, 2/114, 78.4, 96, 128, 231, 232, 269, 912, 901, 908, 920; D2/720, 724; 24/72.5, 442, 443, 446

(56) References Cited

U.S. PATENT DOCUMENTS

| | | | | | |
|---|---|---|---|---|---|
| 1,136,282 | A | * | 4/1915 | Sihler | 2/96 |
| 2,470,031 | A | * | 5/1949 | Harris | 2/76 |
| 3,230,545 | A | * | 1/1966 | Galley | 2/74 |
| D233,634 | S | | 11/1974 | Snider | |
| 4,040,124 | A | | 8/1977 | Zoephel | |
| 4,434,511 | A | | 3/1984 | Weiser | |
| 4,570,268 | A | * | 2/1986 | Freeman | 2/114 |
| 4,686,715 | A | | 8/1987 | Price | |
| 4,718,124 | A | * | 1/1988 | Sawicki et al. | 2/114 |
| D305,575 | S | | 1/1990 | Gordon | |
| 4,964,173 | A | | 10/1990 | Gordon | |
| 5,006,393 | A | * | 4/1991 | Isoe | 428/137 |
| 5,088,117 | A | * | 2/1992 | Fulmer | 2/114 |
| 5,133,086 | A | | 7/1992 | Truitt | |
| 5,157,789 | A | * | 10/1992 | Klass | 2/114 |
| 5,222,258 | A | | 6/1993 | Mucci | |
| D336,968 | S | | 7/1993 | Russano | |
| 5,444,872 | A | * | 8/1995 | Johnson | 2/114 |
| 5,535,453 | A | * | 7/1996 | Howard | 2/269 |
| 5,539,932 | A | * | 7/1996 | Howard | 2/269 |
| 5,575,013 | A | * | 11/1996 | Krack | 2/239 |
| 5,878,437 | A | | 3/1999 | Pater | |
| D422,396 | S | | 4/2000 | Weir | |
| 6,223,352 | B1 | * | 5/2001 | Watlington | 2/80 |

* cited by examiner

*Primary Examiner*—John J. Calvert
*Assistant Examiner*—Alissa L Hoey
(74) *Attorney, Agent, or Firm*—Randal D. Homburg

(57) ABSTRACT

A hospital gown with multiple adjusting elements includes a plurality of T-shaped hem adjustments along a hem of the hospital gown and a rear closure featuring at least three longitudinal hook fabric strips on an outer surface of the hospital gown on one side of the rear closure of the hospital gown, a single S-shaped loop fabric strip on an inside surface of another side of the rear closure of the hospital gown, the hospital gown adjusting to differing heights and body shapes of hospital patients.

2 Claims, 3 Drawing Sheets

UNIVERSAL HOSPITAL GOWN

CROSS REFERENCE TO RELATED APPLICATIONS

None

I. BACKGROUND OF THE INVENTION

1. Field of Invention

A hospital gown with multiple adjusting elements includes a plurality of T-shaped hem adjustments along a hem of the hospital gown and a rear closure featuring at least three longitudinal hook fabric strips on an outer surface of the hospital gown on one side of the rear closure of the hospital gown, a single S-shaped loop fabric strip on an inside surface of another side of the rear closure of the hospital gown, the hospital gown adjusting to differing heights and body shapes of hospital patients.

2. Description of Prior Art

The following United States patents were discovered and are disclosed within this application for utility patent. AH relate to hospital gowns.

Several hospital gowns are disclosed in U.S. Design Pat. No. D442,396 to Weir, U.S. Pat. No. D336,968 to Russano, U.S. Pat. No. D305,575 to Gordon, and U.S. Pat. No. D233,634 to Snider. These designs of gowns indicate several varieties of closures and access sections to patients wearing the gowns, but do not include hem adjustments, nor do they indicate the novel rear closure means of the current invention, having at least three longitudinal strips of hook fabric adapted to engage a single S-shaped loop fabric strip adjusting to differing girths of hospital patients, yet providing a secure and adjustable fit.

Several U.S. Pat. No. 5,878,437 to Pater, U.S. Pat. No. 5,222,258 to Mucci, U.S. Pat. No. 5,133,086 to Truitt, U.S. Pat. No. 5,088,117 to Fulmer, U.S. Pat. No. 4,964,173 to Gordon, U.S. Pat. No. 4,686,715 to Price, U.S. Pat. No. 4,434,511 to Weiser and U.S. Pat. No. 4,040,124 to Zoephel also indicate several varieties of closures and access sections and segmented panels comprising a hospital gown, but again, none of them include hem adjustments, nor do they indicate the novel rear closure means of the current invention, having at least three longitudinal strips of hook fabric adapted to engage a single S-shaped loop fabric strip adjusting to differing girths of hospital patients, yet providing a secure and adjustable fit.

II. SUMMARY OF THE INVENTION

A number of hospital gowns are have been patented which disclose a number of different hospital gowns which allow for several configurations and also providing a variety of different access locations for patients wearing hospital gowns to allow access for medical treatment and insertion of medical devices to their several body parts without having to fully remove their hospital gowns. Modesty is an issue, as is ones appearance in a hospital gown at times. Since no two people share the same height, body shape, girth or configuration, it is desired to provide a hospital gown that allows for full modesty and also adjusts along the rear closure and hemline to conform the hospital gown to the patient wearing the gown.

The primary objective of the invention is to provide a universally fitted hospital gown having a hem adjustment means and an adjustable yet secure fitted closure for a variety of differing size and shaped hospital patients.

III. DESCRIPTION OF THE DRAWINGS

The following drawings are submitted with this utility patent application.

IV. DESCRIPTION OF THE PREFERRED EMBODIMENT

Figure 1:
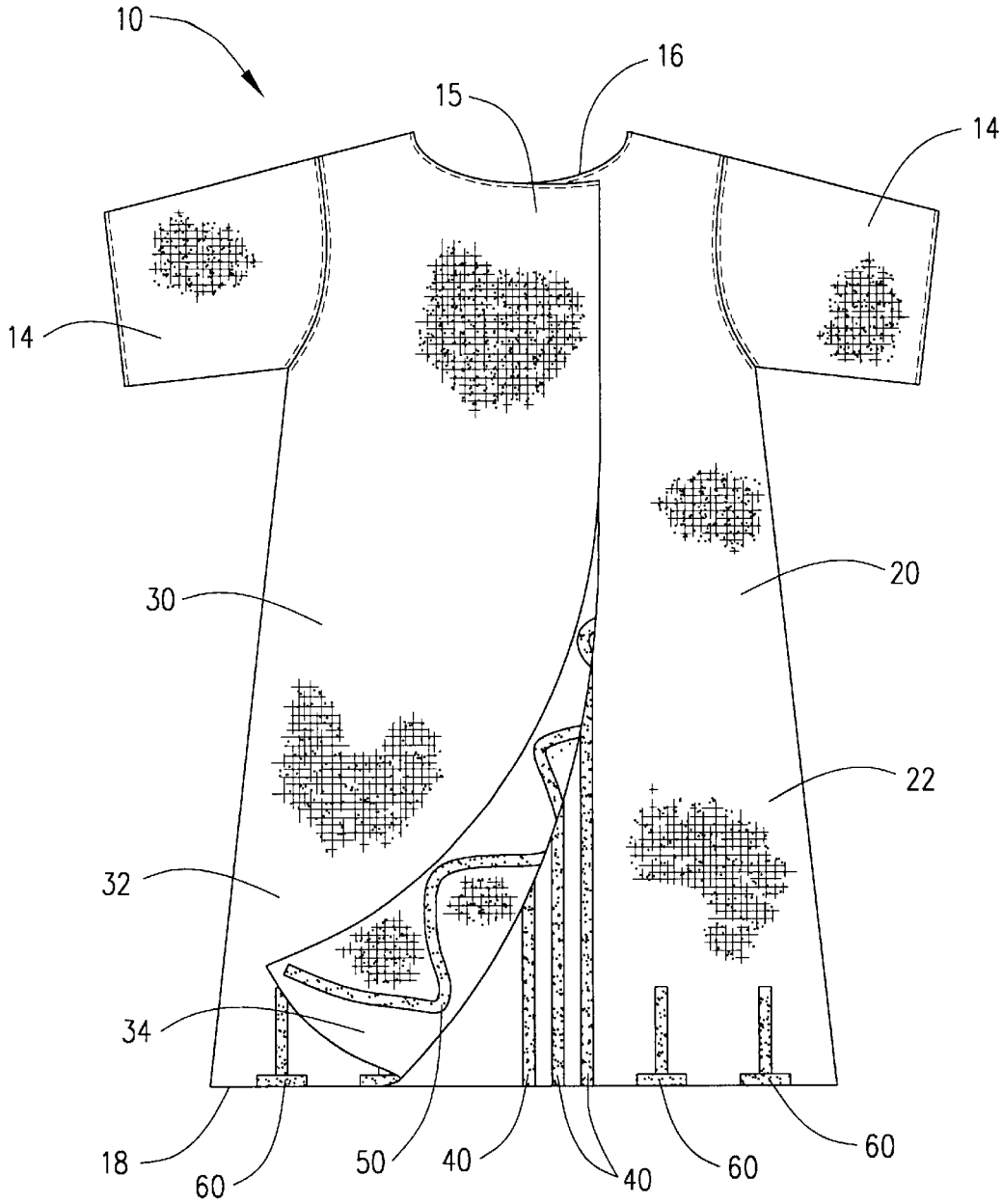
FIG. 1 is a rear view of the universal hospital gown with the rear seam partially open at the bottom.

A universal hospital gown with several adjustment areas, allows for a single gown to adjustably fit a variety of patients with different body sizes, the hospital gown 10, shown in FIGS. 1–4, comprising a front segment 12, sleeves 14 and a rear segment 15 having a first panel 20 including an outer surface 22 and an inner surface 24, and a second panel 30 having an outer surface 32 and an inner surface 34, the first and second panels 20, 30 overlapping, the hospital gown 10 further having a collar 16 and a hem 18, and also having three strips of hook fabric 40 on the outer surface 22 of the first panel 20 running from the collar 16 to the hem 18, a single S-shaped loop fabric strip 50 on the inner surface 34 of the second panel 30, and a plurality of inverted T-shaped hem hook and loop fastening strips 60 which allow the hem 18 to be adjusted to length, while the first panel 20 and second panel 30 are adjustably closed with the S-shaped loop fabric strip 50 engaging the three strips of hook fabric 50 for an adjustable fit depending on the shape of the patient.

Figure 2:
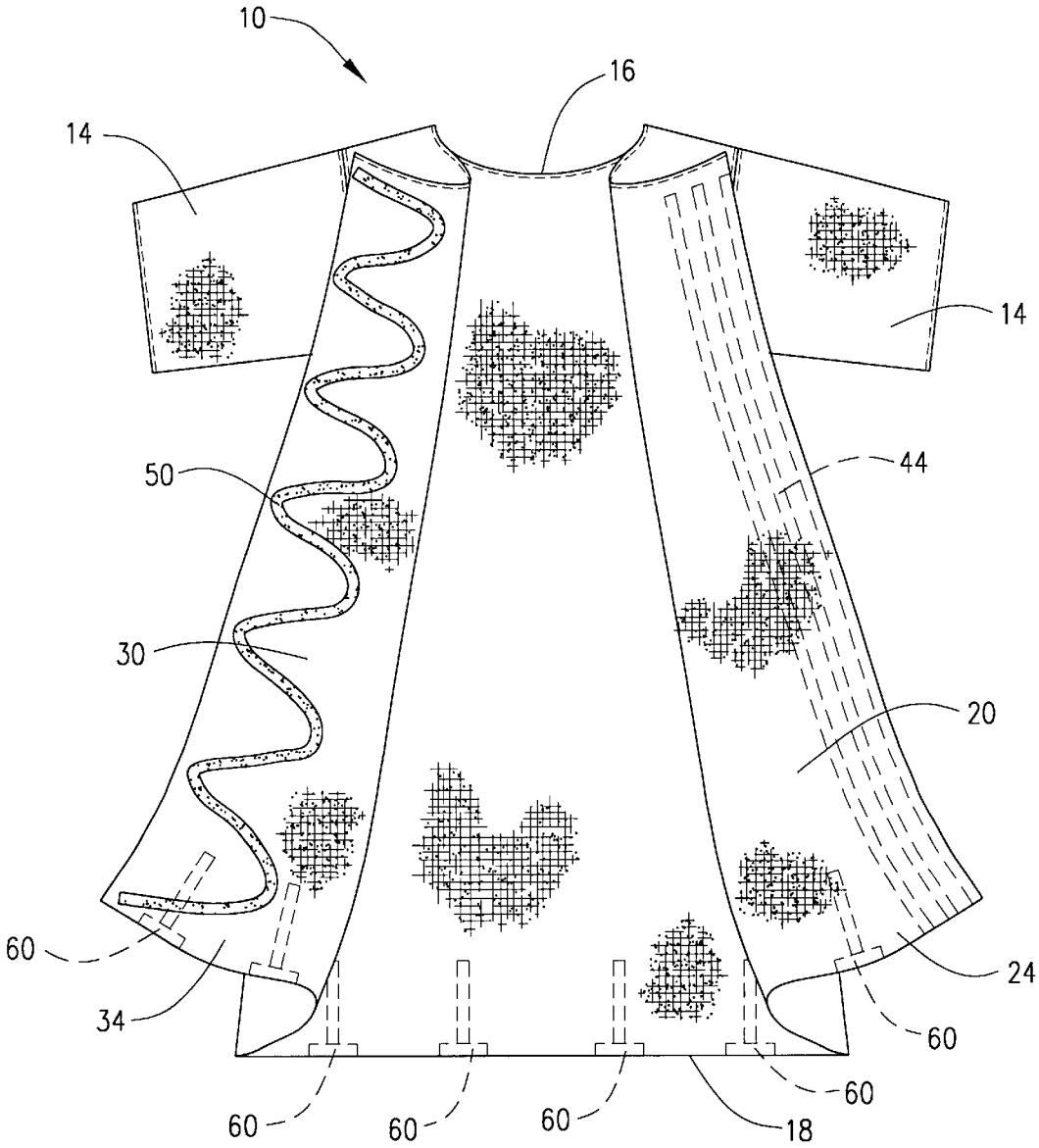
FIG. 2 is a rear view of the hospital gown with the rear seam fully open.
Figure 3:
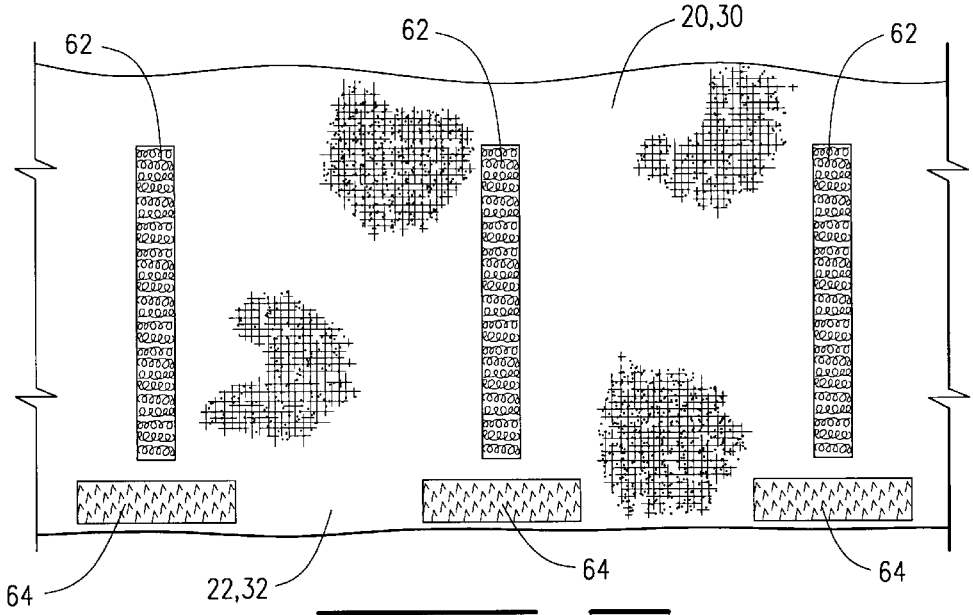
FIG. 3 is a segment view of the full length hem with the hem adjusting hook and loop element.
Figure 4:
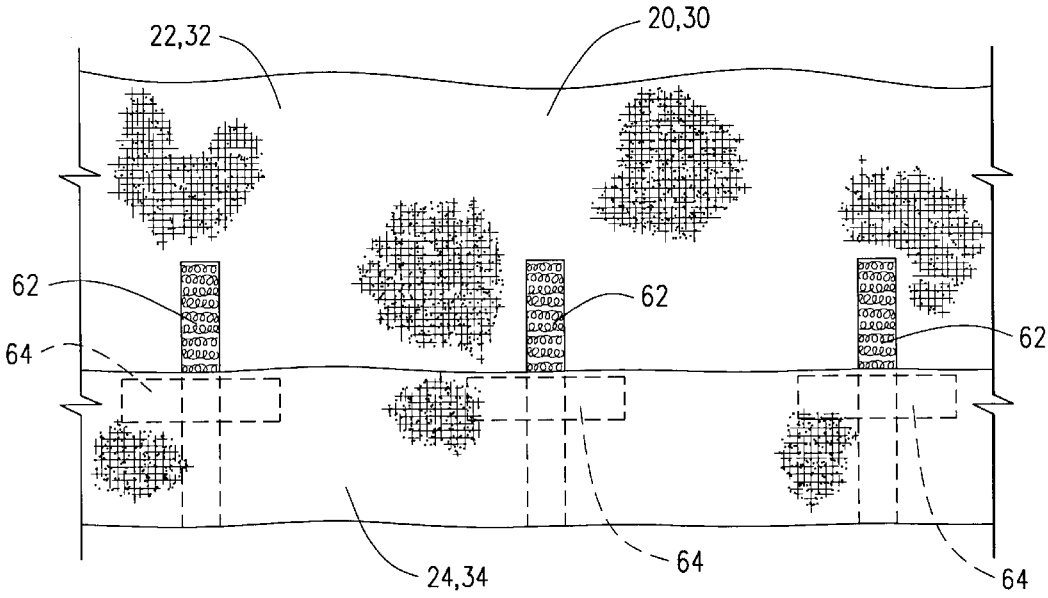
FIG. 4 is a segment view of the hem partially raised with the hem adjusting hood and loop element.

In FIG. 1, the rear segment 15 of the hospital gown 10 is shown with the hem hook and loop fastening strips 60 at full length with the hem 18 at full extension, with the first panel 20 and second panel 30 partially disengaged showing a partial view of the inner surface 34 of the second panel 30 and the outer surface 22 of the first panel 20 with the S-shaped loop fabric strip 50 engaging the three strips of hook fabric 40 near the collar 16 but disengaged at the hem 18. FIG. 2 indicates the hospital gown 10 fully open, fully exposing the S-shaped loop fabric strip 50. FIG. 3 indicates the hem hook and loop fastening strips 60 comprising a vertical loop strip 62 and a horizontal hook strip 64 in each hem hook and loop fastening strip 60. The vertical loop strip 62 and the horizontal hook strip 64 may be independently adjusted upon each other to conform the hem 18 to a desired length, depending on the height of the patient, as shown in FIG. 4.

While the invention has been particularly shown and described with reference to a preferred embodiment thereof, it will be understood by those skilled in the art that changes in form and detail may be made therein without departing from the spirit and scope of the invention.

What is claimed is:

1. A universal hospital gown providing a single gown to adjustably fit a variety of patients with different body sizes, said hospital gown comprising:

a front segment, sleeves and a rear segment having a first panel including an outer surface and an inner surface, and a second panel having an outer surface and an inner surface, the first and second panels overlapping;

a collar and a hem;

three strips of hook fabric on the outer surface of the first panel running from the collar to the hem;

a single S-shaped loop fabric strip on the inner surface of the second panel, the first panel and second panel are adjustably closed with the S-shaped loop fabric strip engaging the three strips of hook fabric for an adjustable fit depending on the shape of the patient; and a plurality of inverted T-shaped hem hook and loop fastening strips which allow the hem to be adjusted.

2. The universal hospital gown as disclosed in claim 1, said hem hook and loop fastening strips further comprising:

a vertical loop strip; and a horizontal hook strip, wherein said vertical loop strip and said horizontal hook strip may be independently adjusted upon each other to conform the hem to a desired length, depending on the height of the patient.

* * * * *